US006771912B1

(12) United States Patent
Mo et al.

(10) Patent No.: US 6,771,912 B1
(45) Date of Patent: Aug. 3, 2004

(54) SYSTEMS AND METHODS FOR GENERATING PHOTO-INDUCED DISCHARGE CURVES

(75) Inventors: Song-Feng Mo, Webster, NY (US); Stephen F. Randall, Rochester, NY (US); Wendy K. Apton, Rochester, NY (US); Jeffrey W. Drawe, Bloomfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/365,471

(22) Filed: Feb. 13, 2003

(51) Int. Cl.[7] ..... G03G 15/00

(52) U.S. Cl. ..... 399/46; 399/48; 399/49; 399/51; 399/53

(58) Field of Search ..... 399/9, 26, 46, 399/48, 49, 51, 53

(56) References Cited

U.S. PATENT DOCUMENTS

| | | | | | |
|---|---|---|---|---|---|
| 4,647,184 | A | | 3/1987 | Russell et al. | 399/48 |
| 4,966,526 | A | | 10/1990 | Amelio et al. | 416/90 R |
| 5,285,241 | A | * | 2/1994 | Scheuer | 399/55 |
| 5,471,313 | A | | 11/1995 | Thieret et al. | 358/296 |
| 5,717,978 | A | * | 2/1998 | Mestha | 399/46 |
| 5,749,021 | A | | 5/1998 | Mestha et al. | 399/49 |
| 5,797,064 | A | | 8/1998 | Raj et al. | 399/46 |
| 5,923,834 | A | | 7/1999 | Thieret et al. | 714/25 |
| 6,006,047 | A | * | 12/1999 | Mara et al. | 399/49 |

* cited by examiner

*Primary Examiner*—Hoan Tran
(74) *Attorney, Agent, or Firm*—Oliff & Berridge, PLC

(57) ABSTRACT

A real-time photo-induced discharge curve (PIDC) model generator uses a nonliner model structure based on the physics of a xerographic system photoreceptor. The PIDC generator estimates a small number of parameters in the PIDC model in real-time for a given xerographic system configuration. The estimated PIDC may be used by xerographic system process controls, diagnostics and xerographic system setup in real-time.

15 Claims, 8 Drawing Sheets

FIG. 6
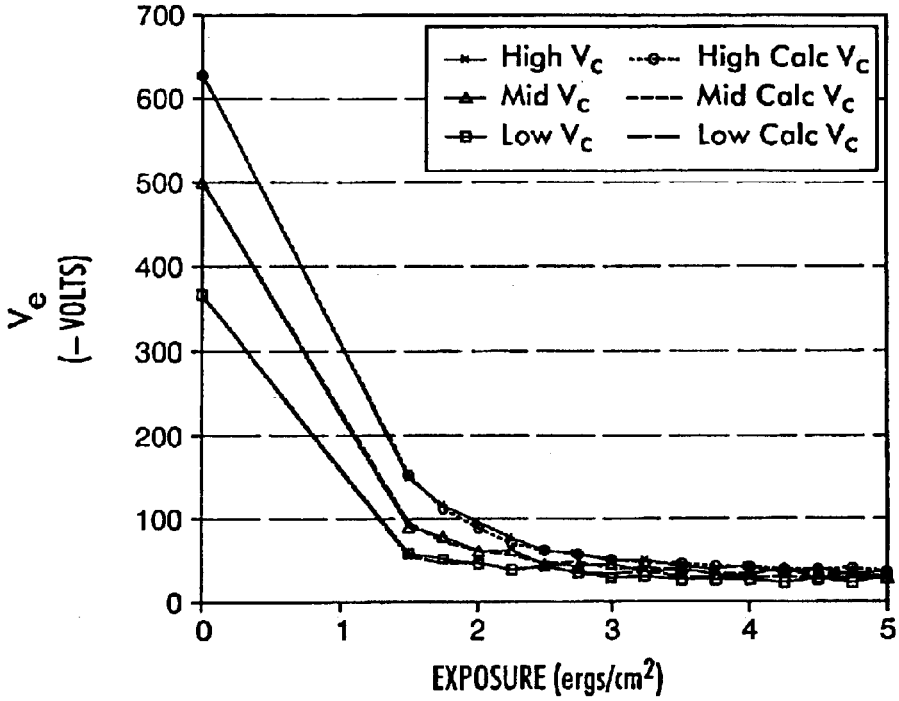
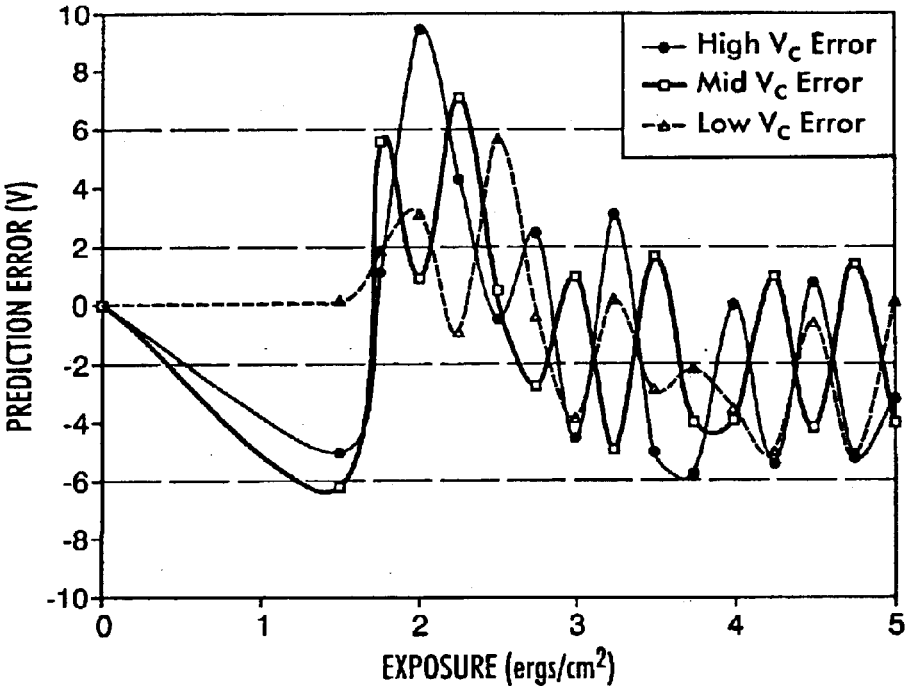
FIG. 7

SYSTEMS AND METHODS FOR GENERATING PHOTO-INDUCED DISCHARGE CURVES

BACKGROUND OF THE INVENTION

1. Field of Invention

This invention concerns creation of a photo-induced discharge curve (PIDC) for the process controls, xerographic setup and diagnostics of a print engine.

2. Description of Related Art

Electrophotographic process characteristics affect images made using a xerographic photoreceptor. The xerographic process includes several steps. The contrast output range characteristics arise mainly from characteristic responses called transfer functions. One of the process steps is charging a photoreceptor and another is exposing a photoreceptor. One important transfer function is that of the photoreceptor.

The transfer characteristic of the photoreceptor system is known as the photo-induced discharge curve (PIDC) and is a plot of the surface potential of the photoreceptor as a function of incident light exposure. The shape of this discharge curve for a given photoreceptor depends on a number of factors, such as, for example, the field dependence, if any, of the photogeneration processes in the photoreceptor pigment, the field dependence of the efficiency of charge injection from the photoreceptor pigment into the photoreceptor transport layer, and the range, i.e., distance per unit field, of the charge carriers in the transport layer. In many practical photoreceptors, the photo-induced discharge curve is approximately linear with light exposure except at low voltages, which corresponds with exposure to high light intensities, where field dependent mechanisms decrease the rate of discharge.

Determining the photo-induced discharge curve for a xerographic system is needed if the system is to operate around the optimum contrast potentials.

U.S. Pat. No. 4,647,184, incorporated herein by reference in its entirety, is one of a number of patents which monitor xerographic system operating parameters and maintain a photo-induced discharge curve (PIDC) for a particular xerographic system once the photo-induced discharge curve (PIDC) for that system has been determined and established. The 184 patent discloses automatic setup systems and methods for establishing basic xerographic system operating parameters. As disclosed in the 184 patent, each xerographic machine is associated with the same development potentials ($V_I$–$V_D$) by adjusting the shape of the photo-induced discharge curve, which was previously determined to ensure uniform output copy quality across a plurality of such xerographic machines.

The photo-induced discharge curve is a fundamental characteristic of a photoreceptor that has been charged to a specific dark potential $V_O$ in combination with the reflective density of the input document and the document illumination intensity. However, any given population of photoreceptors will have a distribution of shapes. Digital values representing the slope of the photo-induced discharge curve are contained within memory of each machine. The setup mode and associated apparatus are designed to measure the basic parameters of the particular machine and plot the photo-induced discharge curve based on these measured values. To the extent that the actual shape of the photo-induced discharge curve varies from a standard shape of the photo-induced discharge curve, the basic parameters of charge voltage $I_C$, developer bias $V_{BIAS}$ and system exposure $E_O$ are adjusted in an iterative process, until the measured values converge on the preset values.

U.S. Pat. No. 5,471,313, incorporated herein in its entirety by reference, discloses a xerographic device whose laser power controller includes a setup routine that determines the relationship between the initial charge on the photoreceptor $V_{hi}$ and exposed voltage $V_{ex}$ as a function of laser power setting and stores these relationships as curves on a graph. These curves provide an initial estimate of the required laser power. A feedback laser power controller takes the initial charge level $V_{hi}$ and a discharge ratio DR and determines an appropriate discharge level from the setup data, measures the exposed value $V_{low}$ on the photoreceptor, and adjusts laser power for changing photoreceptor properties. The discharge ratio $DR=(V_{low}-V_{res})/(V_{hi}-V_{res})$, where $V_{res}$ equals a baseline voltage, measured by exercising laser power exposure until the exposed voltage does not discharge further with increasing exposure power. The discharge ratio indicates how the development potential $V_{dev}$ and cleaning field $V_{clean}$ are positioned on the photo-induced discharge curve, where $V_{clean}$ is a cleaning field equal to the difference between a housing bias voltage and the voltage of areas discharged by exposure.

U.S. Pat. No. 5,797,064 discloses a pseudo photo-induced discharge curve setup procedure for a xerographic system which does not use an electrostatic voltmeter (ESV). The 064 patent determines the knee of the photo-induced discharge curve whenever a photoreceptor or raster output scanner (ROS) is changed. The method of generating the pseudo photo-induced discharge curve is set forth in the 064 patent.

SUMMARY OF THE INVENTION

It has been appreciated that current PIDC generators either take a long time, such as, for example, a number of weeks, to achieve a fine-tuned photo-induced discharge curve or use a number of polynomial curve-fitting techniques that typically are not very accurate.

An accurate real-time PIDC generator makes it possible to achieve better performance for xerographic process control and xerographic system setup and possibly reduced total service hours (TSH) for a xerographic system.

This invention provides systems and methods for generating a photo-induced discharge curve.

This invention separately provides systems and methods for generating the photo-induced discharge curve in real time.

This invention separately provides systems and methods for determining the parameters for a photo-induced discharge curve generator.

This invention separately provides systems and methods that control xerographic processes using a photo-induced discharge curve generator.

This invention separately provides systems and methods that setup a xerographic system using a photo-induced discharge curve generator.

In various exemplary embodiments, the systems and method according to this invention use photoreceptor physics to obtain a nonlinear model structure for a photo-induced discharge curve. In various exemplary embodiments, the systems and methods according to this invention use a nonlinear optimization approach to estimate the parameters utilized by a photo-induced discharge curve generator based on empirical test data for each individual photoreceptor belt at a specific photoreceptor lifetime. In various exemplary embodiments, the systems and methods according to this invention use a nonlinear model structure based on the physics of a photoreceptor, e.g., a photoreceptor belt and/or a photoreceptor drum, and estimate the parameters of an individual photo-induced discharge curve model for applications used by xerographic process controls, xerographic diagnostics, and/or xerographic system setup in real-time. In various exemplary embodiments, the photo-induced discharge curve is obtained sufficiently fast to permit use of the photo-induced discharge curve to affect the operation of the xerographic system for which the photo-induced discharge curve was generated as that system operates.

Various exemplary embodiments of the systems and methods according to this invention create a photo-induced discharge curve generator in real-time.

Various exemplary embodiments of the systems and methods according to this invention use a nonlinear model structure based on the physics of the photoreceptor to generate a photo-induced discharge curve in real-time.

Various exemplary embodiments of the systems and methods according to this invention use a nonlinear parameter estimation approach to estimate the parameters of the PIDC generator for an individual photo-induced discharge curve.

Various exemplary embodiments of the systems and methods according to this invention estimate a number of parameters, such as, for example, four parameters to estimate the parameters of the PIDC generator for an individual photo-induced discharge curve.

Various exemplary embodiments of the systems and methods of this invention use a nonlinear model structure based on the physics of a photoreceptor, e.g., a photoreceptor belt, and estimate the parameters of an individual PIDC model for applications used by process controls, system diagnostics, and xerographic system setup in real-time.

These and other features and advantages of this invention are described in, or are apparent from, the following detailed description of the various exemplary embodiments of the systems and methods according to this invention.

BRIEF DESCRIPTION OF THE DRAWINGS

Various exemplary embodiments of this invention are described in detail, with reference to the following figures, wherein:

FIG. 1 illustrates one exemplary embodiment of a reprographic image forming system that utilizes a photo-induced discharge curve generator according to this invention may be usable with;

FIG. 6 is a graph of photoreceptor potential versus incident light exposure for a model photo-induced discharge curve generated according to one exemplary embodiment of the systems and methods according to this invention;

FIG. 7 is a graph of photo-induced discharge curve error between a variety of model photo-induced discharge curves generated according to the systems and methods according to this invention and corresponding actual photo-induced discharge curves;

DETAILED DESCRIPTION OF EXEMPLARY EMBODIMENTS

Exemplary embodiments of the type of marking engine/printer suitable for use with this invention is described in U.S. Pat. Nos. 4,966,526 and 5,923,834, each of which is hereby incorporated by reference in its entirety. It should be appreciated that the invention can be implemented in a wide variety of image output terminals (IOTs) and is not necessarily limited to a particular marking engine/printing system, such as that shown in FIG. 1, For example, this invention applies to a variety off marking systems besides xerography, such as lithography thermal ink jet, liquid development and thermal transfer.

Figure 1:
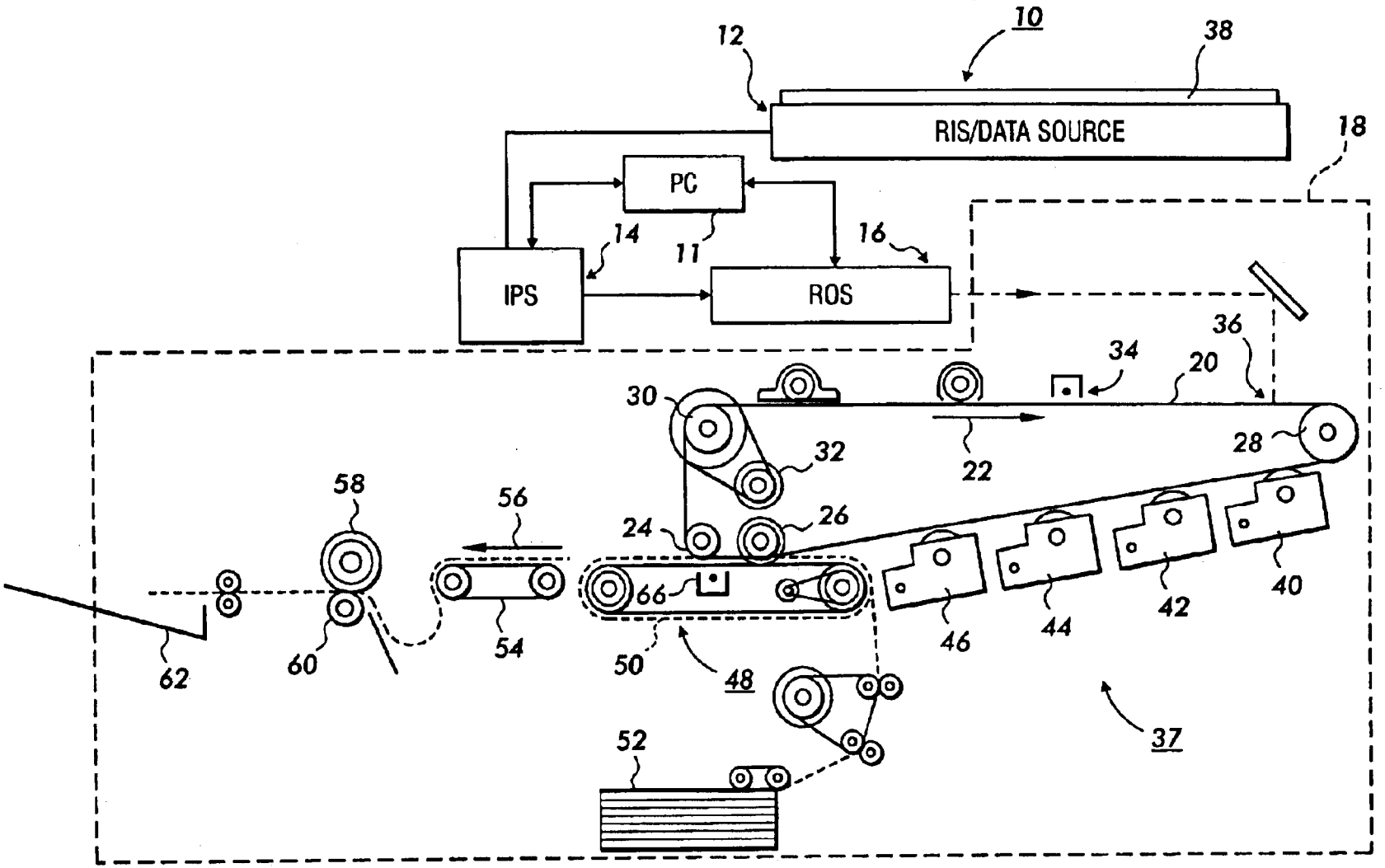

In FIG. 1, during operation of the marking engine/printing system, a multicolor original substrate, such as, for example, a document, 38 is positioned on a raster input scanner (RIS) or other data source 12. The raster input scanner or other data source (such as, for example, a computer generated image) 12 may contain one or more document illumination lamps, optics, a mechanical scanning drive and a charge coupled device (CCD array). The raster input scanner or other data source 12 captures the entire original document and converts the document to a series of raster scan lines and measures a set of primary color densities, i.e., red, green and blue densities, at each of the scan lines. This information is transmitted to an image processing system (IPS) 14. The image processing system 14 is the control electronics which prepare and manage the image data flow to a raster output scanner (ROS) 16. A signal corresponding to the desired image is transmitted from image processing system 14 to raster output scanner 16 which creates the output copy image. The raster output scanner 16 lays out the image in a series of horizontal scan lines with each line having a specific number of pixels per inch. The raster output scanner 16 may include a laser with a rotating polygon mirror block. The raster output scanner 16 exposes the charged photoconductive surface of printer 10 to achieve a set of subtractive primary latent images. The latent images are developed with cyan, magenta, yellow and black developer material, respectively. These developed images are transferred to a copy sheet and superimposed in registration with one another to form a multicolored image on the copy sheet. This multicolored image is then fused to the copy sheet forming a color copy.

As shown in the exemplary embodiment of FIG. 1, a printer or marking engine may be embodied an electrophotographic printing machine 18. The electrophotographic printing machine 18 employs a photoreceptor or photoconductive belt 20. The belt 20 moves in the direction of arrow 22 to advance successive portions of the photoconductive surface sequentially through the various processing stations disposed about the path of movement. The belt 20 is entrained about transfer rollers 24 and 26, a tension roller 28 and a drive roller 30. The drive roller 30 is rotated by a motor 32 coupled thereto by suitable means such as a belt drive. As the drive roller 30 rotates, the belt 20 is advanced in the direction of arrow 22. Initially, a portion of the photoconductive belt 20 passes through a charging station 34. At the charging station 34, corona generating devices or a scorotron charges the photoconductive belt 20 to a relatively high substantially uniform potential.

Next, the charged photoconductive surface of the belt 20 is moved to an exposure station 36. The exposure station 36 receives image information from the raster input scanner or other data source 12. If using a raster input scanner, the raster input scanner may have a multicolored original document 38 positioned thereon. The raster input scanner 12 captures the entire image from the original document 38 and converts the image to a series of raster scan lines which are transmitted as electrical signals to the image processing system 14. The electrical signals from the raster input scanner 12 correspond to the red, green and blue densities at each point in the document. The image processing system 14 converts the set of red, green and blue density signals, i.e., the set of signals corresponding to the primary color densities of the original document 38, to a set of calorimetric coordinates. The image processing system 14 then transmits signals corresponding to the desired image to the raster output scanner 16. The raster output scanner 16 includes a laser with rotating polygon mirror blocks. Preferably, a nine-facet polygon is used. The raster output scanner 16 emits a beam which illuminates the charged portion of the photoconductive belt 20 at a rate of 400 pixels per inch. The raster output scanner 16 exposes the photoconductive belt 20 to record four latent images. A first latent image is adapted to be developed with cyan developer material. A second latent image is adapted to be developed with magenta developer material, with a third latent image adapted to be developed with yellow developer material and a fourth with black material. Each latent image is formed by the raster output scanner 16 on the photoconductive belt 20 corresponding to the signals from the image processing system 14.

After the latent images are recorded on the photoconductive belt 20, the belt 20 advances the image thereon to a development station 37. The development station 37 includes four individual developer units 40, 42, 44 and 46 which develop the latent images using toner particles of appropriate color, as conventionally done. After development, the toner is moved to a transfer station 48 where the toner image is transferred to a sheet of support material 52, such as plain paper. At the transfer station 48, the a sheet conveyor 50 moves the sheet into contact with the photoconductive belt 20. At the transfer station 48, a scorotron 66 sprays ions onto the backside of the sheet to charge the sheet to a proper magnitude and polarity for attracting the toner image from the photoconductive belt 20. In this way, the four color toner images are transferred to the sheet in superimposed registration with one another. After the sheet is fed around the sheet conveyor 50 four times, the sheet is released and fed to another sheet transport 54 in the direction of arrow 56 between a fuser roll 58 and a pressure roll 60 and then is deposited in a sheet receiving tray 62.

Figure 2:
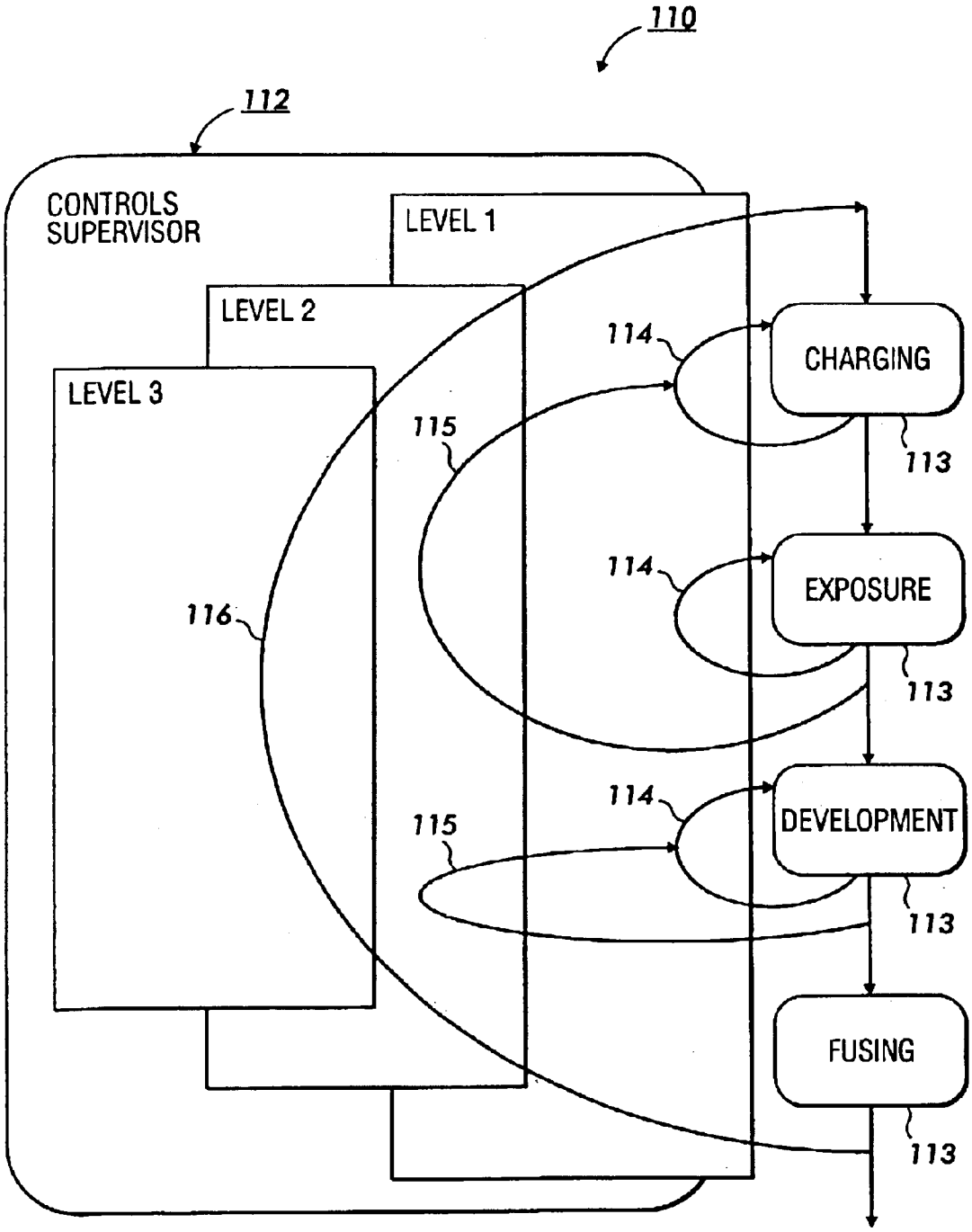
FIG. 2 is a schematic plan showing one exemplary embodiment of a control architecture for the system of FIG. 1.

A hierarchical process control architecture 110, as shown generally in FIG. 2, can be implemented in a printer, such as the exemplary printer 10 shown in FIG. 1, or in any other suitable marking device to provide required data to a diagnostic server. The hierarchical process control architecture 110 may be implemented in the process controls 11 in the marking engine 18, as shown in FIG. 1, and indicates a close relationship between a diagnostic server and the marking engine being serviced. In accordance with various embodiments of this invention, intimate, low level details of operation and state of operation are communicated from a marking engine to a diagnostic server on frequent, regular intervals. The control architecture 110 is an example of the more general notion of close coupling between sewer and marker. The internals of the control structure for different technologies may differ, but are similar in providing intimate and detailed data to a diagnostic server on the state and operation of a machine engine marking device to provide required data to a diagnostic server.

The control architecture 110 in the process controls 11 communicates with the image processing system 14 and the raster output scanner 16 to control the quality of images output by the printer 10. A primary object of the control architecture 110 is to maintain a desired image quality for the image output terminal by maintaining a desired tone reproduction curve (TRC). An image input to be copied or printed has a specific tone reproduction curve. The image output terminal outputting a desired image has an intrinsic tone reproduction curve. If the image output terminal is allowed to operate uncontrolled, the tone reproduction curve of the image output by image output terminal will distort the color rendition of the image. Thus, an image output terminal must be controlled to match its intrinsic tone reproduction curve to the tone reproduction curve of the input image. An intrinsic tone reproduction curve of an image output terminal may vary due to changes in such uncontrollable variables such as humidity or temperature and the age of the xerographic materials, i.e., the number of prints made since the developer, the photoreceptor, etc. were new. As shown in FIG. 2, to accommodate and to correct for the various changes, the control architecture 110 takes a system-wide view of the image output terminal marking engine and controls both the various physical subsystems 113 of the image output terminal and the inter-relationships between subsystems 113.

As shown in FIG. 2, the control architecture 110 may be divided into three levels: Level 1, Level 2 and Level 3. The control architecture 110 also has a a control supervisor 112 for coordinating the interactions between the controllers of the various levels. Level 1 includes a controller 114 for each of the subsystems 113. Subsystems 113 can be, for example, the charge, exposure, development, or fusing stations of a xerographic device. Level 2 includes at least two controllers 115 which cooperate with the Level 1 controllers 114. Level 3 includes at least one controller 116. Each of the controllers function and communicate with other controllers through specific interfaces provided in the control supervisor 112 in addition to direct connections.

In general, at Level 1 the algorithms are responsible for maintaining their corresponding subsystems at their setpoints. Level 2 determines what those setpoints should be and notifies the Level 1 algorithms of it's decisions to change them. Level 2 examines for example, the toner patches in the interdocument zones of the photoreceptor placed there by the patch scheduling algorithm and the optical sensor reads those patches to determine the amount of toner placed there by the development system. The patches may be either full solid area patches or 50% (for example) halftone patches. From the densities of these patches, the Level 2 algorithms determine the appropriate setpoints for the electrostatic voltages and toner concentration. Level 2 does not acknowledge the tone reproduction curve as an entity, only as three points (maximum darkness white and some intermediate darkness (50% in the example). Level 3 treats the tone reproduction curve as a curve made up of a number of discrete points (the three from Level 2 and usually about 4–6 more. For further details on the control architecture 110, reference may be made to U.S. Pat. No. 5,471,313, which is incorporated herein by reference in its entirety.

Level 1 controllers 114 are required to maintain a scalar setpoint for each subsystem 113 to allow for short term stability of the subsystems 113 which is required by Level 2 algorithms. Each subsystem 113 has a separate controller 114 which directly controls the particular parameter or performance setpoint of that particular subsystem. Level 1 controllers 114 are sent information by various information sensors which sense the subsystem performance parameters locally as shown by the direct control loops depicting controllers 114 shown in FIG. 2. The sensed parameters are sent through a single process step or algorithm from which actuation control parameters are output to control various image output terminal subsystems 113. Two separate algorithms may be provided for each Level 1 controller 114. One algorithm provides rapid response time when a Level 1 subsystem setpoint is changed to allow for quick stabilization required by Level 2 controllers 115. The second algorithm provides for noise immunity during a normal subsystem operation in which a setpoint is not changed. The control supervisor 112 provides the means for determining which algorithm will adjust the activator value.

Level 2 controllers 115 operate regionally, rather than operating locally as do Level 1 controllers 113. Level 2 controllers 115 control an intermediate process output. Input to the algorithms of Level 2 controllers 115 consist of a composite set of scalar quantities including temperature, humidity, developer age and any other factor affecting Level 2 controllers 115. Two examples of regional control configurations are shown in FIG. 2, but any appropriate configuration which operates regionally may be used. Level 2 controllers 115 receive input data from either an information processing system in the printer 10 or a scanner in a copier or a user interface. The input data informs Level 2 controllers 115 what the customer desires to be output. It is important to note that an image output desired by the customer may not always be exactly the same image that is input. That is, the customer may want to customize or change the appearance of the image.

The data input to Level 2 controllers 115 comprises multiple bits per pixel multiple bits per pixel of a desired image to be output by an image output terminal. It is assumed that the input data are to be reproduced exactly as transmitted. That is, the colorimetric coordinates of the input image should match the measured colorimetric coordinates in the corresponding regions-of the image output by the image output terminal. In order for the architecture of this invention to accomplish this colorimetric coordinate matching function, the tone reproduction curve intrinsic in a particular image output terminal must be determined. A tone reproduction curve of a particular image output terminal is sensed by an optical sensor viewing test patches placed on the photoreceptor. Once an intrinsic tone reproduction curve of a particular image output terminal is determined, the Level 2 controllers 115 control discrete points on the intrinsic tone reproduction curve to match the tone reproduction curve of the input image date. That is, the tone reproduction curve allows the image output terminal to output an image that corresponds to the image desired by the customer. Level 2 controllers 115 do this by sensing and deriving various discrete setpoints corresponding to the intrinsic image output terminal tone reproduction curve. Then, Level 2 controllers 115 sense the performance of the setpoints of the tone reproduction curve with respect to corresponding setpoints on the desired tone reproduction curve.

Level 2 controllers 115 send Level 1 subsystem performance parameter recommendations to controls supervisor 112. As described later, controls supervisor 112 either accepts or adjusts these parameter recommendations and sends them to the Level 1 subsystem actuators to change the performance of Level 1 subsystems 113. By changing the Level 1 subsystems performances by a controlled amount, the Level 2 setpoints are maintained at their desired locations on the tone reproduction curve. To sense and create the intrinsic tone reproduction curve, Level 2 controllers 115 select the darkest or densest bit from the input data stream and assigns this density a value corresponding to the highest setpoint on a tone reproduction curve. Level 2 controllers 115 also select a certain density level, for example 50%, and assign this bit another density value corresponding to another setpoint on the tone reproduction curve. The lowest setpoint on the tone reproduction curve is always 0 and corresponds to background or white area on the image input Level 2 controllers 115 set the white areas or 0 density areas of the input image and maintain this background area by maintaining a constant value of $V_{clean}$. $V_{clean}$ is the cleaning voltage, which is used to indicate the background in printing and is discussed in U.S. Pat. No. 5,749,021 the entirety of which is incorporated herein by reference. Thus, Level 2 controllers 115 set up at least three points on the tone reproduction curve which are used to control the image output process.

Level 2 controllers 115 then sense the performance of the image output terminal corresponding to the few discrete points set up by Level 2 controllers 115 on the tone reproduction curve of the input image. That is, Level 2 controllers sense what density level is output and what density level is input and compares the two. If the setpoint of the intrinsic tone reproduction curve moves or is different from the input density level, then the controllers 115 send a Level 1 parameter recommendation to correct for this difference. Level 2 controllers continuously check the output of the few discrete points to control these points on the tone reproduction curve.

While the Level 2 controllers control the solid area and halftone area or the upper and middle regions of the tone reproduction curve, and $V_{clean}$ maintains the lower end of the tone reproduction curve, other setpoints along the tone reproduction curve must be set up and controlled to produce an image with a desired color stability. These other regions are known as the highlight and shadow regions which experience variations in output density values just as the other areas do. The Level 3 controller 116 provides setpoints to control the output of the highlight and shadow regions and controls these setpoints to produce a high quality image output. Level 3 controller 116 senses the performance of the image output terminal corresponding to the highlight and shadow region setpoints and compares the performance data to the input data. Level 3 controller 116 then corrects for any difference between output performance data and input data by changing how raster input scanner 12 interprets the input image.

Figure 3:
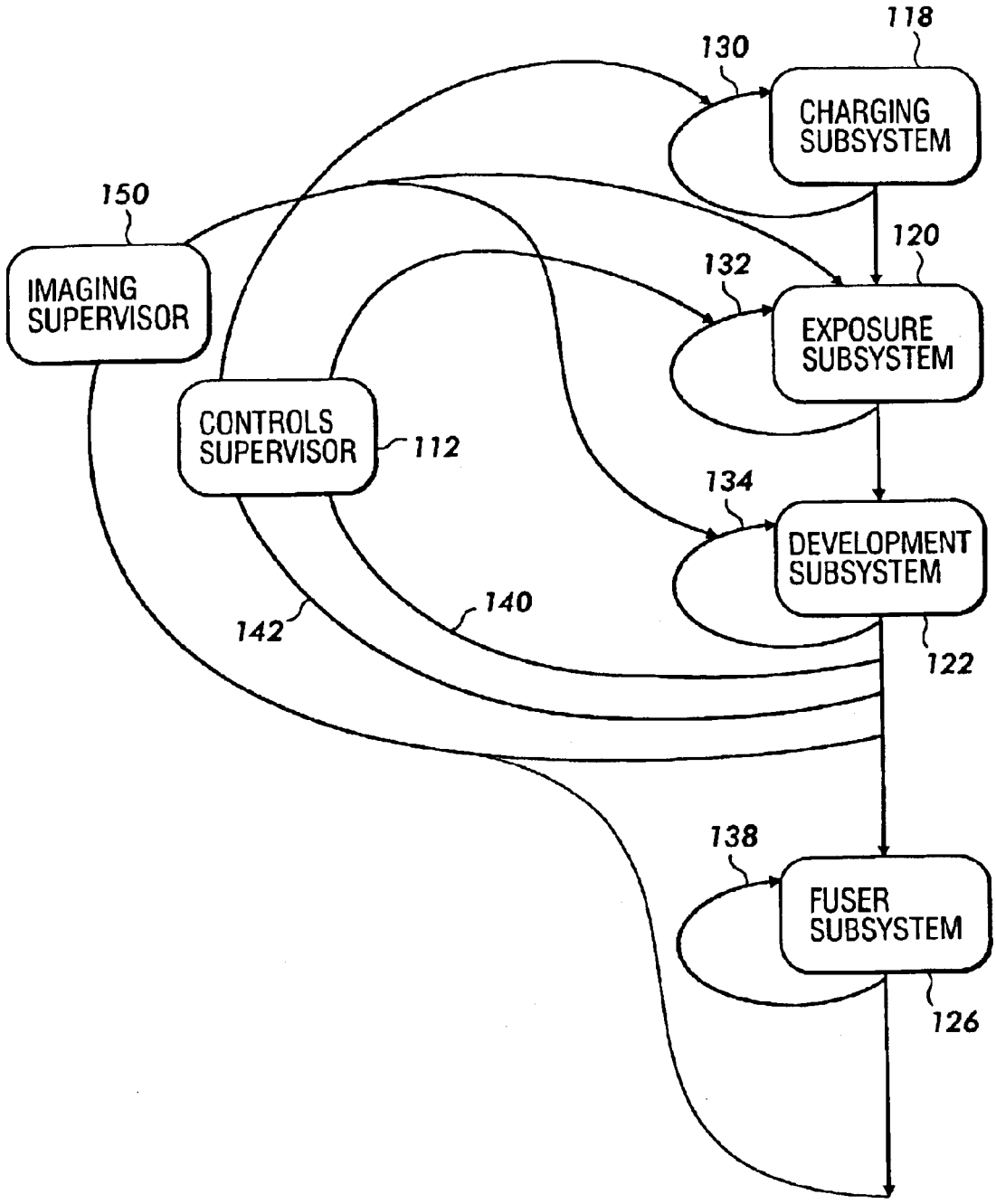
FIG. 3 is another view of the exemplary embodiment of the control architecture for the system of FIG. 1.

In one exemplary embodiment shown in FIG. 3, Level 1 subsystems to be controlled may include a charging subsystem 118, an exposure subsystem 120, a development subsystem 122, and a fuser subsystem 126. Further, any other physical subsystems of a printer or copier can be easily controlled and included in the architecture. The Level 1 subsystems controllers may include any or all of the following controllers: a charging controller, an laser power controller, a toner concentration controller, a transfer efficiency controller, a fuser temperature controller, a cleaning controller, a de-curler controller and a fuser stripper controller. Other image output terminal controllers which control various physical subsystems of the image output terminal not mentioned here can be used by simply designing the controllers such that they can be controlled by controls supervisor 112 as shown in FIG. 2 and can be inserted in a plug and play manner, as described above.

In order to offer customers value added diagnostic services using add-on hardware and software modules which provide service information on copier/printer products, a hierarchy of machine servers may be used in accordance with this invention. In the following, "machine" is used to refer to the device whose performance is being monitored, including, but not limited to, a copier or printer. "Server" is used to refer to the device(s) which perform the monitoring and analysis function and provide the communication interface between the "machine" and the service environment. Such a server may comprise a computer with ancillary components, as well as software and hardware parts to receive raw data from various sensors located within the machine at appropriate, frequent intervals, on a continuing basis and to interpret such data and report on the functional status of the subsystem and systems of the machine. In addition to the direct sensor data received from the machine, a knowledge of the parameters in the process control algorithms (Levels 1, 2 and 3) is also passed in order to acknowledge the fact that process controls attempt to correct for machine parameter and materials drift and other image quality affectors.

One quality of control systems is that the effects of drift are masked through compensatory actuation until the operational boundaries (latitudes) are reached. Thus, the control system algorithm parameters may be interrogated to assess the progress of the system toward the latitude bounds. If the distance from the bounds can be determined and the rate of system degradation toward those bounds assessed, then a prediction may be made which forecasts the time of failure of the component approaching latitude bounds. Such a server, would have sufficient storage capacity to allow machine data and their interpretations to be stored until such time that the server is prompted to report through a local display or a network. The server may also be programmed to provide alert signals locally or through a network connection when the conditions of the machine, as detected by the server, required immediate attention.

In addition, when degradation of components or performance is detected, predictions of the impending failure cause a series of actions to occur depending on the service strategy for the machine. These actions may range from key operator notification of the predicted need for service to actually placing an order for the appropriate part for "just in time" delivery prior to actual part failure. The server is equipped to perform a set of specific functions for each family of products and would provide instructions for customer or a service representative to perform whatever repair, part replacement, etc. that may be necessary for the maintenance and optimum operation of the machine. Such functions include status of periodic parts replacement due to wear or image quality determinations which may require adjustment of operational parameters of various modules or replacement of defective components.

The software that is loaded in such a server would, in part, be generic to common modules among all machine and in part, specific to the machine that the customer has purchased. The server may be configured to serve one or more machines within the same campus and be capable of receiving such data from various machines over radio transmitter, phone lines, or network connection. The server thus will provide the interpretation of the complex raw data that continually emanates from various components and modules of the machine(s), and will be able to provide the customer information on the nature of the actions that need to be taken to maintain the machine for optimum performance.

The concepts of "Basic Diagnostics" and "Value Added Diagnostics" are implemented by providing only uninterpreted (raw) data at the machine interface as a basic diagnostic component. The server accepts this raw data and interprets the data to provide reduced service time (even zero if the customer performs the service action) resulting from the specific and correct diagnosis of both actual as predicted failures of machine parts. This server is given very intimate details of the inter workings of the machine being monitored and thus provides similarly detailed information about the state of each individual component. This information is useful not only for field service diagnostics but also before and after product life in manufacturing by testing the behavior of the individual components and comparing the behavior to standard, known, correct the behavior in remanufacturing by remembering exactly which part failed and providing information, for example, as a database entry that may be specific to a part and/or serial number.

Figure 4:
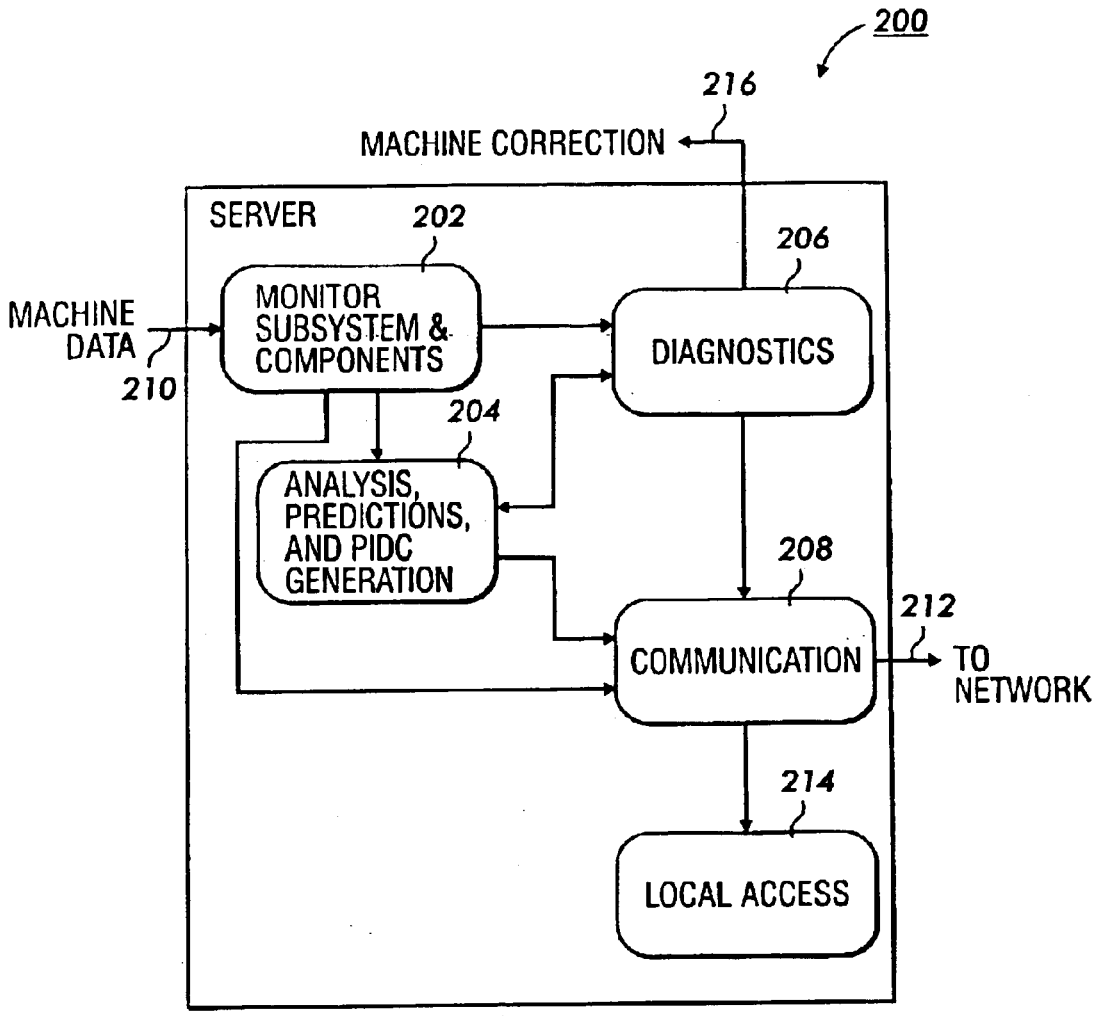
FIG. 4 is a schematic view of a machine server and interface in accordance with this invention.

In the exemplary embodiment shown in FIG. 4, a server 200 includes a subsystem and component monitor 202, an analysis and predictions component 204, a diagnostic component 206 and a communication component 208. It should be understood that suitable memory may be included in the server 200, the monitor 202, the analysis and predictions component 204, the diagnostics component 206 and the communication component 208. The monitor 202 contains a preprocessing capability including a feature extractor which isolates the relevant portions of data to be forwarded on to the analysis and diagnostic elements. In general, the monitor 202 receives machine data, as illustrated at 210, and provides suitable data to the analysis and predictions component 204 to analyze machine operation and status and track machine trends such as usage of disposable components as well as usage data, and component and subsystem wear data. Diagnostic component 206 receives various machine sensor and control data from the monitor 202, as well as data from the analysis and predictions component 204 to provide immediate machine correction, as illustrated at 216, as well as to provide crucial diagnostic and service information through communication component 208, for example, via a line 212 to an interconnected network to a remote server on the network or to a centralized host machine with various diagnostic tools such as an expert system. Such information may include suitable alarm condition reports, requests to replenish depleted consumable, and data sufficient for a more thorough diagnostics of the machine. A local access 214 or interface for a local service representative may be provided to access various analysis, prediction, and diagnostic data stored in the server 200, as well as to interconnect any suitable diagnostic device.

However, in this invention, a Level 1 analysis is an analysis performed by a machine server over and above the ordinary or routine analysis in a given machine. Thus, a Level 1 analysis may be an analysis done by the monitor 202, the analysis and predictions component 204 and/or the diagnostic component 205 that is beyond a typical machine analysis. This may include some level of trend tracking, such as tracking machine fault trends, tracking component wear, and tracking machine usage as discussed above. This level of information may be forwarded over a network to a more sophisticated monitor and may also be available over a local or remote access by a service representative or even a trained operator.

The discharge characteristics of a photoreceptor, such as, for example, a photoreceptor belt/drum, change over the life of the photoreceptor. The systems and methods according to this invention create a photo-induced discharge curve (PIDC) generator in real-time, such as, for example, in terms of milliseconds, to be able to monitor the changing discharge characteristics of photoreceptors on a real-time basis over the life of the photoreceptor.

In one exemplary embodiment of the systems and methods according to this invention, a nonlinear model may be used, for example, as a general photo-induced discharge curve model structure. This nonlinear model is, in various exemplary embodiments, defined as:

$$Ve-Vr-V_t^2/(Ve-Vr)=Vc-Vr-V_t^2/(Vc-Vr)-S*Exp \quad (1)$$

where:

Ve is the voltage image reading from the electrostatic voltmeter;

Vr is the residual voltage on the photoreceptor at infinite raster output scanner exposure;

$V_t$ is the transition point of Ve;

Vc is the voltage image reading from the electrostatic voltmeter when the raster output scanner is off;

S is the sensitivity coefficient, and

Exp is the raster output scanner exposure level in ergs/$cm^2$.

Eq. (1) assumes the printer in which the model defined in Eq. (1) uses a charge area development (CAD) system. For a printer that uses a discharge area development (DAD) system, the sign of the voltage related variables would be changed, i.e., absolute values for Ve, Vc, and Vr need to be used in Eq. (1).

The photoreceptor discharge data may be obtained in any suitable manner, including by using an electrostatic voltmeter and the raster output scanner.

After derivation, Eq. (1) may be rewritten as:

$$Ve=Vr+A+(A^2+V_t^2)^{1/2}. \quad (2)$$

In various exemplary embodiments, in Eq. (2), A is defined as:

$$A=\frac{1}{2}(((Vc-Vr)^2-V_t^2)/(Vc-Vr)-S*\mathrm{Exp}). \quad (3)$$

In various exemplary embodiments, in Eq. (2), the transition point $V_t$ is defined as:

$$V_t=V_{t0}*Vc; \quad (4)$$

where $V_{t0}$ is the coefficient of the transition point $V_t$.

Similarly, in various exemplary embodiments, in Eqs. (1) and (3), the sensitivity coefficient S is defined as:

$$S=S_0(1-e^{-k*Vc}) \quad (5)$$

where:

$S_0$ is the coefficient of the sensitivity coefficient S; and k is the degradation rate of the voltage on the photoreceptor belt.

In various exemplary embodiments according to the systems and methods of this invention, the nonlinear model parameters defined above for Eqs. (1)–(4) that may be estimated in real-time based on the PIDC test data are the residual photoreceptor voltage $V_r$, the transition point voltage $V_{t0}$, the coefficient $S_0$ of the sensitivity coefficient and the degradation rate k of the voltage on the photoreceptor.

Based on the PIDC test data, it is possible to estimate these parameters and obtain a PIDC model in real-time.

According to the systems and methods of this invention, several applications of the PIDC model exist.

In various exemplary embodiments, the PIDC model may be used in exposure setup, for example, by an algorithm:

$$E_N=\frac{1}{S}\left[\left(\frac{(|Vc|-|Vr|)^2-|Vt|^2}{(|Vc|-|Vr|)}\right)-\left(\frac{(|Ve|-|Vr|)^2-|Vt|^2}{(|Ve|-|Vr|)}\right)\right], \quad (6)$$

where:

the values for the sensitivity coefficient S, the residual photoreceptor voltage Vr, and the transition point Vt are obtained from the PIDC model defined in Eq. (1)

Ve is defined as being equal to Vr+DR*(Vc−Vr); and

DR is a pre-defined parameter.

In various exemplary embodiments of this invention, DR is defined as:

$$DR=(V_e-V_r)/(V_c-V_r) \quad (7)$$

During a xerographic printer setup mode, quality may be measured by a tone area coverage (TAC) sensor. Toner area coverage sensors are typically implemented as infrared reflectance densitometers that measure the density of toner particles developed on the surface of the photoreceptor. Both the setup and runtime modes use feedback from the toner area coverage sensor and other information to achieve nominal tone reproductive curve targets. As a result, a discharge ratio needs to be keep within a certain range to get the best tone reproduction curve and other image quality.

Figure 5:
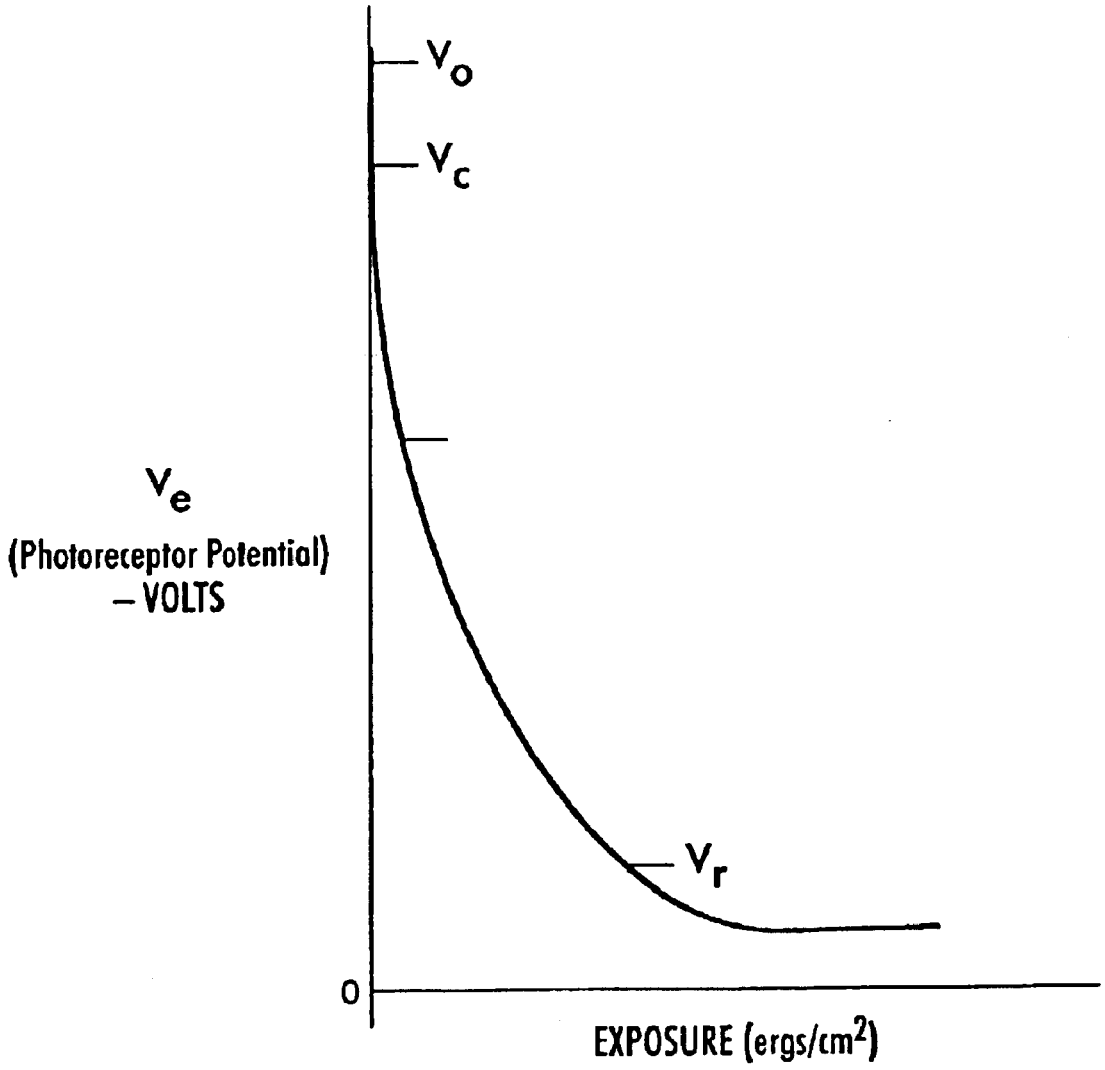
FIG. 5 is a graph of photoreceptor potential versus incident light exposure, illustrating one exemplary embodiment of a photo-induced discharge curve for an exemplary xerographic system.

FIG. 5 illustrates these parameters in terms of a photo-induced discharge curve. FIG. 6 illustrates three photo-induced discharge curves generated according to the systems and methods of this invention, each based on calculated and empirically measured values.

Using the photo-induced discharge curve model according to this invention, an initial exposure level $E_N$, that is, the raster output scanner exposure level, typically measured in ergs per square centimeter, may be selected, and process control system designed, to maintain the discharge ratio within a desired range.

The discharge ratio may also be checked while process control is running to determine, for example, if the discharge ratio is within the desired range, and to make process control adjustments if the discharge ratio is out of range.

In various exemplary embodiments, the photo-induced discharge curve model may be used in real-time to estimate the expected voltage level $V_e$ applied to the photoreceptor, where the expected voltage level $V_e$ can be used to determine the development field, which will reduce the chance that process controls can run into the air breakdown zone, i.e., to permit the photoreceptor to fully discharge in order to create a strong electric field in the process nip without air breakdown, to avoid impairing of the latent image on the photoreceptor.

In various exemplary embodiments, the photo-induced discharge curve model may be used to diagnose problems in the raster output scanner and/or an electrostatic voltmeter, and/or a subsystem's defects based on the expected voltage level applied to the photoreceptor and the actual applied voltage level reading from the electrostatic voltmeter.

Figure 8:
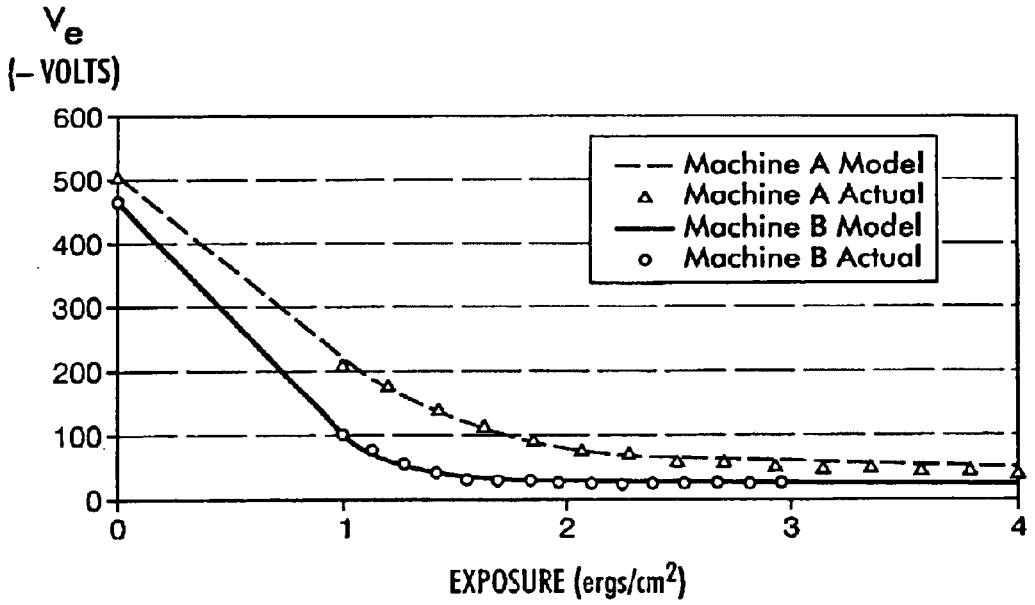
FIG. 8 is a graph showing a pair of exemplary photo-induced discharge curves based on one exemplary embodiment of a photo-induced discharge curve model generator according to this invention.

As noted above, photo-induced discharge curve parameters change with different xerographic machines, although the model photo-induced discharge curve structure does not change. Because of this, there is a need to estimate photo-induced discharge curve parameters in real-time. Two sets of empirical photo-induced discharge curve data from two different models of xerographic machines are set forth, below, in Table 1, and are illustrated in FIG. 5. Table 1, below, lists the four parameters discussed above, i.e., $V_{t0}$, which is the coefficient of $V_t$, $S_0$, which is the coefficient of S, k, which is the degradation rate of the voltage on the photoreceptor belt, and $V_r$, which is the transition point of $V_e$, for a model A xerographic machine and a model B xerographic machine. FIG. 8 shows both the model PIDCs generated using various exemplary embodiments of the systems and methods according to this invention and actual, empirical photo-induced discharge curve data for both machines.

| PIDC ID: Model A | | |
|---|---|---|
| Inputs: | Vto | 0.202678 |
| | So | 410.678833 |
| | k | 0.003002 |
| | Vr | 33 |

| PIDC ID: Model B | | |
|---|---|---|
| Inputs: | Vto | 0.128986 |
| | So | 482.356445 |
| | k | 0.003986 |
| | Vr | 17 |

As noted above, FIG. 6 shows a set of the photo-induced discharge curves. Comparison between test data and the predictions of the various exemplary embodiments photo-induced discharge curve generator 204 according to various systems and methods of this invention, for more than one hundred sets of photo-induced discharge curve data, using more than thirty photoreceptors, e.g., photoreceptor belts, each having different discharge characteristics, revealed that predictions based on this photo-induced discharge curve generator 204 have a maximum prediction error that is less than plus or minus 10 volts. FIG. 6 shows typical photo-induced discharge curves with test data and the predicted photo-induced discharge curve from the photo-induced discharge curve generator 204 according to this invention. FIG. 7 shows prediction errors for the photo-induced discharge curve generator 204. These errors are less than 10 volts.

In various exemplary embodiments of the photo-induced discharge curve generator systems and methods according to this invention may be used as part of a xerographic system setup to help reduce xerographic system setup time and help to obtain improved toner reproduction curve control performance.

As mentioned above, the photo-induced discharge curve model is a nonlinear function. Estimating photo-induced discharge curve parameters can be considered as nonlinear modeling, i.e., curve fitting when the model depends nonlinearly on a set of N unknown parameters $a_k$, k=1,2, . . . , N. The chi-square ($\chi^2$) merit function, also characterized as a goodness-of-fit test, may be used to determine the best-fit photo-induced discharge curve parameters by minimizing the value of the chi-square merit function. Since the photo-induced discharge curve model is a nonlinear function, minimizing the chi-square merit function may proceed iteratively. Assuming trial values for the parameters, a procedure that improves the trial solution is developed. That procedure is then repeated until the value of the chi-square merit function ($\chi^2$) stops decreasing, i.e., until $\chi^2$ is less than a tolerance value or until a maximum iteration is reached.

In various exemplary embodiments of the systems and methods of this invention, the model to be fit may take the following general form:

$$y=y(x;\ a) \tag{8}$$

where:

y is Ve in Eq. (2);

x is Exp in Eq. (3);

$y(x;\ a)=Vr+A+(A^2+V_t^2)^{1/2}$ as in Eq. (2); and $a=[V_{t0},\ S_0,\ k]^T$, which is the parameter vector that needs to be optimized through minimizing the chi-square merit function $\chi^2$.

It should be appreciated that the value of the residual voltage Vr may be estimated based on the value of the expected voltage Ve at the minimum charge level and maximum exposure level.

The chi-square merit function $\psi^2$ may be defined as:

$$\chi^2(a)=\sum_{i=1}^{M}((y_i-y(x_i;\ a))/\sigma_i)^2. \tag{9}$$

The chi-square merit function $\chi^2$ is expected to be well-approximated by a quadratic form, at least locally, and may be written as:

$$\chi^2(a)\approx c-b*a+\frac{1}{2}*a*D*a, \tag{10}$$

where:

b is an N-vector; and

D is an N×N matrix.

If the approximation is a good approximation, the current trial parameter may be replaced with parameter $a_{min}$ in a single step. That is:

$$a_{min}=a_{cur}+D^{-1}*[-\nabla\chi^2(a_{cur})]. \tag{11}$$

On the other hand, if the approximation obtained from Eq. 9 is a relatively poor local approximation to the shape of the function that is being minimized using the current parametric vector $a_{cur}$, a step down the gradient may be taken. That is:

$$a_{next}=a_{cur}-c^*\nabla\chi^2(a_{cur}) \tag{12}$$

where the constant c is small enough not to exhaust the downhill direction.

In order to use Eqs. (11) or (12), the gradient of the chi-square merit function $\chi^2$ may be determined for any set of parameters a. To use Eq. (11), one may also use the matrix D, which is the second derivative matrix of the chi-square merit function $\chi^2$, at any a.

The gradient of the chi-square merit function $\chi^2$ with respect to the set of parameter values a, which will be zero at the chi-square merit function $\chi^2$ minimum, has components:

$$\partial\chi^2/\partial a_k=-2\sum_{i=1}^{M}(y_i-y(x_i;\ a))/\sigma_i^2*(\partial y(x_i;\ a)/\partial a_k)\ k=1,\ 2,\ \ldots\ N. \tag{13}$$

An additional partial derivative may be taken that yields:

$$\partial^2\chi^2/\partial a_k\partial a_l = 2\sum_{i=1}^{M} 1/\sigma_i^2(\partial y(x_i;a)/\partial a_k)*(\partial y(x_i;a)/\partial a_l) - (y_i - y(x_i;a))*\partial^2 y(x_i;a)/\partial a_l\partial a_k. \quad (14)$$

The factors of two may be removed by defining:

$$\beta_k \equiv -\frac{1}{2}\partial\chi^2/\partial a_k; \text{ and} \quad (15)$$

$$\alpha_{kl} \equiv \frac{1}{2}\partial^2\chi^2/\partial a_k\partial a_l. \quad (16)$$

As a result of setting $\alpha$ in Eq. (11) to 1/2 D, Eq. (16) can be rewritten as a set of linear equations:

$$\sum_{l=1}^{N} \partial a_k\partial a_l = \beta_k. \quad (17)$$

This set of linear equations may be solved for the increment $\delta a_l$ that, added to the current approximation, gives the next approximation.

Eq.(12), which is the steepest descent formula, will then be:

$$\delta a_l = \text{constant}*\beta_l. \quad (18)$$

The second derivative term is negligible when it is close to zero or it is small enough to be negligible when compared to the term involving the first derivative. It also has an additional possibility of being ignorably small in practice.

The term multiplying the second derivative in Eq. (14) is $y_i - y(x_i; a)$. It may be desirable that this term be the random measurement error of each point. In various exemplary embodiments of the systems and methods according to this invention, $\alpha_{kl}$ may be defined as:

$$\alpha_{kl} = \sum_{i=1}^{M} 1/\sigma_i^2(\partial y(x_i;a)/\partial a_k)*(\partial y(x_i;a)/\partial a_l). \quad (19)$$

In various exemplary embodiments of the systems and methods according to this invention, the optimization method explained below may be used to minimize the chi-square merit function $\chi^2$.

For Eq. (14), Eq. (18) may be replaced by:

$$\delta a_l = (1/\lambda\alpha_{ll}))*\beta_l \text{ or } \lambda\alpha_{ll}\delta a_l = \beta_l, \quad (20)$$

where $\lambda$ is a tolerance factor number.

It should be appreciated that a, should be positive and this is guaranteed by the definition given in Eq. (19).

Also, a new matrix $\alpha'_{jj}$ may be defined as:

$$\alpha'_{jj} \equiv \alpha_{jj}(1+\lambda) \quad (21)$$

where:

$$\alpha'_{jk} \equiv \alpha_{jk}. \quad (22)$$

Both Eqs. (17) and (20) maybe replaced as:

$$\sum_{l=1}^{N} \alpha'_{kl}\delta a_j = \beta_k. \quad (22)$$

When the tolerance factor number $\lambda$ is very large, the matrix $\alpha'$ is forced into being diagonally dominant. As a result, Eq. (23) approaches equation (20). On the other hand, as the tolerance factor number $\lambda$ approaches zero, Eq. (23) approaches equation (17).

Figure 9:
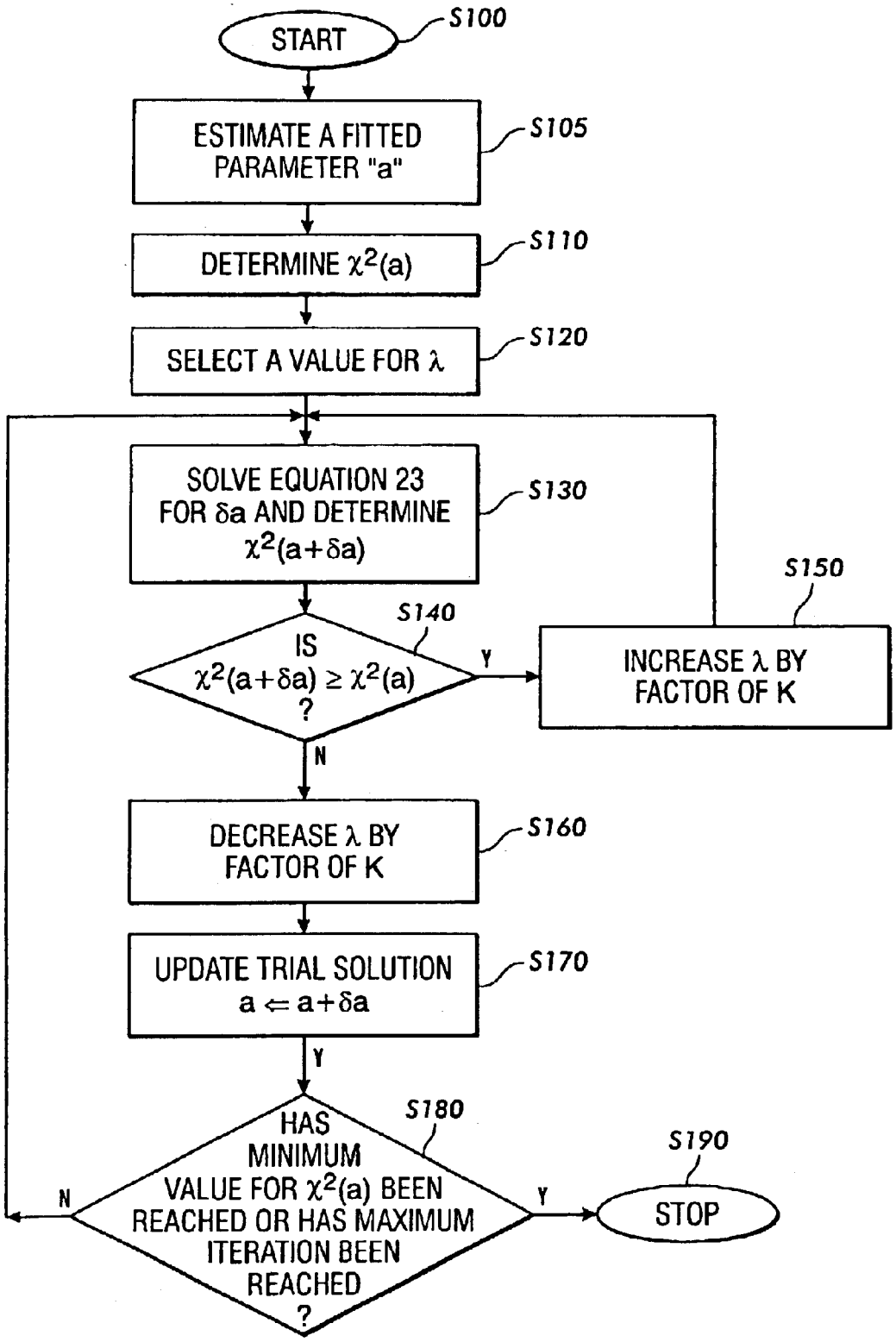
FIG. 9 is a flowchart outlining one exemplary method for estimating the photo-induced discharge curve parameters according to this invention.

In various exemplary embodiments according to the systems and methods according to this invention, photo-induced discharge curve parameters may be estimated as outlined in FIG. 9. The process begins in step S100. Control proceeds to step S105 where a fitted parameter a is estimated. Then, in step S110, the chi-square merit function of the fitted parameter a, i.e., $\chi^2(a)$, is determined. Next, in step S120, a relatively a modest value for the tolerance factor number $\lambda$ is selected. Then, in step S130, the linear Eq. 22 is solved for $\delta a$ and $\chi^2(a+\delta a)$ is evaluated. It should be appreciated that a robust algorithm is desirably used to solve Eq. 22 due to a singularity issue, which is an indication that a given set of photoreceptor measurements by, for example, an electrostatic voltmeter, may not be sufficient to determine the photo-induced discharge curve. Moreover, if the singularity of a given set of photoreceptor measurements is inadequate, the method may acquire more photoreceptor measurements.

Next, in step S140, a determination is made whether $\chi^2(a+\delta a)$ is equal to or greater than $\chi^2(a)$. If so the tolerance factor number $\lambda$ is increased in step S150 by a factor of K, and control returns to step S130. However, if $\chi^2(a+\delta a)$ is determined to be less than $\chi^2(a)$, the tolerance factor number $\lambda$ is decreased in step S160 by a factor of K and the trial solution $a \leftarrow a+\delta a$ is updated in step S170. Then, control continues to step S180 to determine if a minimum value for $\chi^2(a)$ has been reached, i.e., if $\chi^2(a)$ is smaller than a tolerance number, or if the maximum iteration number has been reached. If so, control proceeds to step S190 where the process ends. If not, control returns to step S130.

The exemplary photo-induced discharge curve nonlinear modeling and real time photo-induced discharge curve generation processes disclosed above may be performed in generation element 204 which, as noted above, is also used to analyze machine operation and status, and to track machine trends, such as usage of disposable components, usage data, and component and/or subsystem wear data.

While particular exemplary embodiments of this invention have been described in conjunction with the exemplary embodiments outlined above, it is evident that many other alternatives, modifications, variations and improvements and substantial equivalents that are or may be presently unforeseen may arise to applicants or other skilled in the art. Accordingly, the exemplary embodiments of the invention, as set forth above, are intented to be illustrative and not limiting. Various charges may be made without departing from the spirit and scope of the invention.

What is claimed is:

1. A method of creating a real-time photo-induced discharge curve for a system having a photoreceptor, the system including a nonlinear photo-induced discharge curve model of the system, the method comprising:

estimating in real-time a residual voltage on the photoreceptor at an infinite radiant energy exposure of the photoreceptor;

estimating in real-time a first coefficient related to a photoreceptor image voltage reading when the photoreceptor is not exposed to imaging radiation;

estimating in real-time a sensitivity coefficient;

estimating in real-time a degradation rate of the voltage on the photoreceptor; and determining a real time photo-induced discharge curve for the photoreceptor based on estimated residual voltage, the first coefficient, the sensitivity coefficient and the degradation rate.

2. The method of claim 1, further comprising:

modifying at least one parameter, characteristic and/or element of the system based on the determined photo-induced discharge curve.

3. The method of claim 2, wherein modifying at least one parameter, characteristic and/or element of the system comprises selecting an initial exposure level based on the determined photo-induced discharge curve.

4. The method of claim 2, wherein modifying at least one parameter, characteristic and/or element of the system comprises estimating a photoreceptor image voltage level.

5. The method of claim 2, wherein modifying at least one parameter, characteristic and/or element of the system comprises selecting an initial photoreceptor development bias voltage.

6. The method of claim 2, wherein the xerographic system includes a raster output scanner, a charge device, a photoreceptor, and/or an electrostatic voltmeter; and modifying at least one parameter, characteristic and/or element comprises diagnosing one or more of the raster output scanner, the charge device, the photoreceptor, and/or the electrostatic voltmeter.

7. The method of claim 2, wherein modifying at least one parameter, characteristic and/or element comprises estimating a discharge ratio and keeping the estimated discharge ratio within range during process controls and/or setup.

8. The method of claim 1, further comprising defining the nonlinear photo-induced discharge curve model of the system using a chi-square goodness of fit test.

9. The method of claim 1, further comprising defining a nonlinear photo-induced discharge curve model of the system by:

determining $\chi^2(a)$, where $$\chi^2(a) \approx c - b*a + \frac{1}{2}*a*D*a;$$

selecting a tolerance value $\lambda$;

solving a linear equation for $\lambda a$ and evaluating $\chi^2(a+\delta a)$;

increasing the tolerance value $\lambda$ by a factor of K;

solving the linear equation based on the determined value of $\lambda$;

determining if $\chi^2(a+\delta a) \geqq \chi^2(a)$;

increasing $\lambda$ by a factor of K if $\chi^2(a+\delta a) \geqq \chi^2(a)$;

determining if $\chi^2(a+\delta a) < \chi^2(a)$;

decreasing $\lambda$ by a factor of K if $\chi^2(a+\delta a) < \chi^2(a)$;

updating the trial solution $a \leftarrow a+\delta a$;

solving the linear equation based on the determined value of $\lambda$; and stopping when $\chi^2(a)$ is smaller than a tolerance number or when a maximum iteration number has been reached.

10. A real-time photo-induced discharge curve generator usable in a system having a photoreceptor, comprising:

at least one estimating circuit, routine or application that estimates in real-time:

a residual voltage on the photoreceptor at infinite radiant energy exposure of the photoreceptor, a first coefficient related to a photoreceptor image voltage reading when the photoreceptor is not exposed to imaging radiation, a sensitivity coefficient, and a degradation rate of the voltage on the photoreceptor; and a circuit, routine or application that determines a photo-induced discharge curve for the photoreceptor based on the estimates of the residual voltage, the first coefficient, the sensitivity coefficient, and the degradation rate.

11. The generator of claim 10, further comprising:

a circuit, routine or application that modifies at least one parameter, characteristic and/or element of the system based on the determined photo-induced discharge curve.

12. The generator of claim 11, wherein the modifying circuit, routine or application selects an initial exposure level based on the determined photo-induced discharge curve.

13. The generator of claim 11, wherein the modifying circuit, routine or application estimates a photoreceptor image voltage level based on the determined photo-induced discharge curve.

14. The generator system of claim 11, wherein the system comprises at least one of a raster output scanner, a charge device, a photoreceptor and an electrostatic voltmeter; and wherein the modifying circuit, routine or application diagnoses at least one of the raster output scanner, the charge device, the photoreceptor and the electrostatic voltmeter.

15. The generator of claim 11, wherein the modifying circuit, routine or application estimates a discharge ratio and keeps the discharge ratio within a defined range during process controls and/or setup of the system.

* * * * *